US006761555B2

(12) United States Patent
Sarani et al.

(10) Patent No.: US 6,761,555 B2
(45) Date of Patent: Jul. 13, 2004

(54) DEVICE FOR AUTOMATICALLY PRODUCING AN OPENING OR CAVITY IN THE SIDE OF A CERAMIC PRODUCT DURING MOLDING IN A MOULD

(75) Inventors: Giorgio Sarani, Borgo Tossignano (IT); Davide Visani, Bologna (IT)

(73) Assignee: Sacmi Cooperativa Meccanici Imola Soc. Coop. a r.l., Imola (IT)

( * ) Notice: Subject to any disclaimer, the term of this patent is extended or adjusted under 35 U.S.C. 154(b) by 113 days.

(21) Appl. No.: 09/986,599

(22) Filed: Nov. 9, 2001

(65) Prior Publication Data

US 2003/0026867 A1 Feb. 6, 2003

(30) Foreign Application Priority Data

Aug. 3, 2001 (EP) ..... 01830519

(51) Int. Cl.[7] ..... B28B 7/16

(52) U.S. Cl. ..... 425/468; 249/178; 249/179; 249/183

(58) Field of Search ..... 425/405.1, 468; 249/175, 178, 179, 183; 264/314

(56) References Cited

U.S. PATENT DOCUMENTS 5,087,193 A * 2/1992 Herbert, Jr. ..... 425/543

5,578,158 A * 11/1996 Gutowski et al. ..... 156/285

FOREIGN PATENT DOCUMENTS

| | | |
|---|---|---|
| GB | 2 027 634 A | 2/1980 |
| JP | 5-285919 | 11/1993 |
| JP | 5-285920 | 11/1993 |

OTHER PUBLICATIONS

Machine translation of Japanese Pub. No. 5–285920.*

Japanese Patent No. 5–285920, Abstract only.

Japanese Patent No. 5–285919, Abstract only.

* cited by examiner

*Primary Examiner*—James P. Mackey
*Assistant Examiner*—Donald Heckenberg
(74) *Attorney, Agent, or Firm*—Arent Fox

(57) ABSTRACT

A device for producing an opening or cavity in the side of a ceramic product during product molding in a mould with a molding cavity delimited by a molding surface which has a window, comprising a deformable punch, joined on the window, designed to project into or retract from the molding cavity, with the ability to vary its rigidity. The device comprises punch shape variation differential constriction means and actuator means for punch deformation, which together produce a controlled anisotropic punch deformation, which makes the punch project into the molding cavity.

55 Claims, 2 Drawing Sheets

DEVICE FOR AUTOMATICALLY PRODUCING AN OPENING OR CAVITY IN THE SIDE OF A CERAMIC PRODUCT DURING MOLDING IN A MOULD

BACKGROUND OF THE INVENTION

The present invention relates to a device for automatically producing an opening or cavity in the side of a ceramic product during molding in a mould.

A technique for forming sanitaryware conventionally includes casting of the slip in chalk moulds, that is to say, moulds in which the absorbency of the chalk is used to dehydrate the ceramic slip during molding.

However, the molding methods according to said technique require lengthy periods for molding the items and even longer for drying the moulds.

Moreover, the life of the chalk moulds is relatively brief, since it is limited to around one hundred cycles.

Nowadays, said technique is increasingly substituted by molding with slip pressure casting in porous resin moulds.

Compared with molding using chalk moulds, this molding technique advantageously allows a significant reduction in cycle times and an important increase in the life of the moulds, which can be subjected to several tens of thousands of molding cycles.

The reduction in cycle times and, above all, the increase in the life of the mould justify the attempt to insert into it equipment which allows a set of operations which were conventionally performed manually to be carried out on the item produced, for example, the punching of overflow holes (washbasins, bidets, etc.) or water supply holes (flushing cistern).

When the axis of the holes is parallel with the mould release direction, these holes are easy to obtain (and often obtained) with fixed punches. In other cases, that is to say, when the axis of the holes is at an angle to the direction of mould release, to prevent the punch from damaging the item during mould release, the punch is removed before mould release.

For this punch removal operation there are known mechanical devices with various technological configurations which are housed in the mould, such as pneumatic cylinders, hydraulic cylinders or control cables.

However, the molding technique which uses these mechanical devices is not without problems.

A first problem relates to keeping the ceramic slip pressurized during item molding. The fluid slip, inserted in the mould by pressure casting, tends to easily fill the spaces between the mobile parts of the devices, required by the functional movements of the devices, meaning that the use of complex sealing systems which are not easily implemented is essential.

A second problem relates to the size of these devices inside the mould. Their arrangement in the moulds is often not compatible with the circuits which carry the fluids essential to implementation of the molding cycle through the mould and which allow correct mould operation.

This general difficulty with coexistence often means that the device cannot be made, due to the practical impossibility of physically positioning devices of this type in the moulds.

Further problems, linked to the previous ones, are: limited mould reliability over time; difficulty in inspecting the mould for any maintenance which may be required; difficulty in finding materials for making devices which combine satisfactory resistance to abrasion and to oxidation in contact with the slip.

These problems are added to by: difficulties in constructing the physical means which allow a movement of the punch suitable for its removal; and the high costs of such means.

SUMMARY OF THE INVENTION

The aim of the present invention is to solve all the problems in the prior art by providing a device for producing an opening or cavity in the side of a ceramic product during product molding in a mould, the mould having a molding cavity delimited by a molding surface with a window, the device comprising a punch joined on the window in such a way that it projects into or, vice versa, is retracted from the molding cavity. In the device according to the invention, the punch is deformable with variations in its rigidity. The device also comprises punch shape variation differential constriction means and actuator means for punch deformation which, in the active condition, are designed to change the shape of the punch by counteracting the opposite reaction of the constriction means. The constriction means and actuator means produce a controlled, anisotropic deformation of the punch designed to make the punch project into the molding cavity.

BRIEF DESCRIPTION OF THE DRAWINGS

The technical features of the present invention, in accordance with the above-mentioned aims, are set out in the claims herein and the advantages more clearly illustrated in the detailed description which follows, with reference to the accompanying drawings, which illustrate a preferred embodiment without limiting the scope of application, and in which:

DESCRIPTION OF THE PREFERRED EMBODIMENTS

Figure 1:
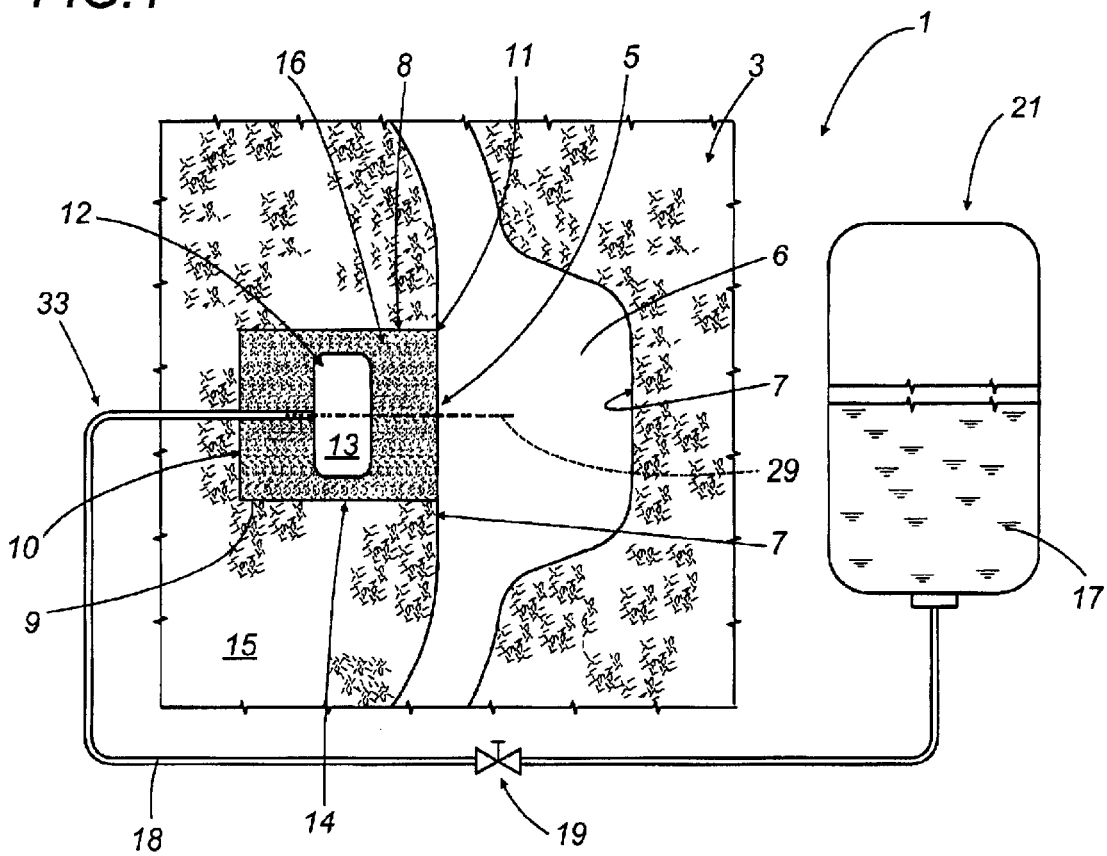
FIG. 1 is a schematic view of a mould for molding ceramic products, illustrated in a first assembly configuration.

With reference to the accompanying drawings, the numeral 1 denotes as a whole a device for producing an opening 4 or cavity in the side of a ceramic product 2 during molding in a mould 3.

The device 1 basically comprises: a punch 5 for forming the opening 4 or cavity, designed to be suitably deformable, with a variable increase in rigidity; actuator means 33 for deforming the punch 5; and constriction means 14 and 8 for constraining the free deformation of the punch 5—following application of the load of the actuator means 33—counteracting it in a differential fashion, so that the deformation is suitably anisotropic and controlled.

The punch 5 is joined to a window 11 made in a molding surface 7 surrounding a molding cavity 6 in the mould 3 and, thanks to the above-mentioned deformation capacity, can project into the molding cavity 6 of the mould 3 or vice versa, it can be retracted from the molding cavity 6, below or behind the molding surface 7: this punch 5 projection and retraction is suitably synchronized with the ceramic product 2 molding process.

As illustrated in FIG. 1, the punch 5 comprises an expandable cover 12 whose shape may change, housed in a seat 14 in the body 15 of the mould 3 and having an internal cavity 13 which can hold a fluid substance 17 which makes the cover 12 deformable due to the body mobility of and/or any pressurization applied to the fluid substance 17 in the cavity 13 from outside.

The cover 12 may be made in the form of a membrane which expands due to a difference in the pressure acting between the fluid substance 17 contained in the cavities 13 and the outside environment.

The membrane which forms the cover 12 may be made using an elastomeric material able to withstand significant expansion due to the difference in pressure between the cavity 13 and the outside, or it may be made of a material which is not elastic, or an elastic material which expands only slightly under the action of the pressure load.

Between the end deformability limits of the cover 12 indicated above, the cover 12 may have an entire range of intermediate elasticity values, which may be obtained not only with a suitable choice of material for the membrane, but also by integrating the membrane with a framework 36.

The framework 36, which may be incorporated, for example, in the membrane structure during the formative process, can be made in various ways, one being the insertion of a sheet of fabric or mesh in the body of material which is the cover 12.

If the sheet of fabric or, even better the mesh, are shaped in such a way as to provide local resistances which vary from one zone of the cover 12 to another, not only is it possible to regulate the degree of elasticity of the cover 12 as a whole, but it is also possible to regulate the elasticity of the cover 12 from one zone to another, allowing the cover 12 to produce a preset anisotropic deformation which is differentiated from one zone to another.

Figure 2:
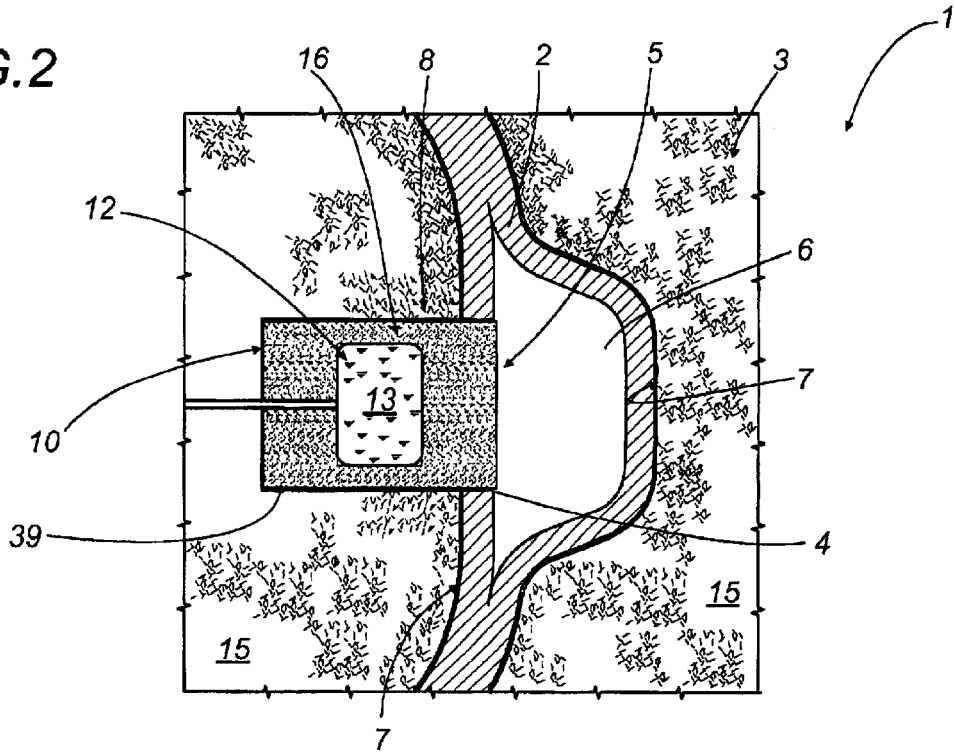
FIG. 2 is a schematic assembly view of the mould illustrated in FIG. 1, in a second, different assembly configuration.
Figure 3:
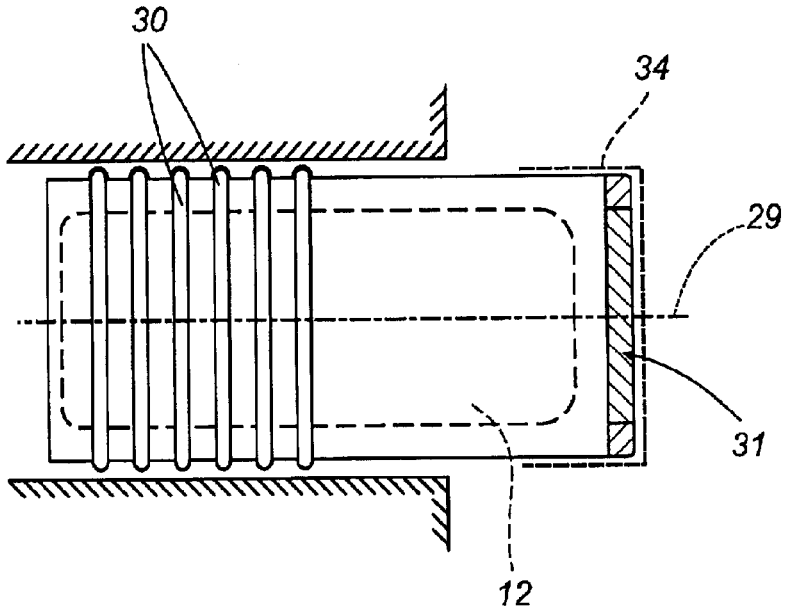
FIGS. 3 and 4 are respectively a first and a second alternative embodiment of a detail of the mould illustrated in the previous Figures.

As regards its configuration, the cover 12 may be made in various ways, representing embodiments which are provided by way of example, without limiting the scope of the invention. In FIGS. 1, 2 and 3 the cover 12 may have a single connection configuration, that is to say, with a single lobe. In contrast, in FIG. 4 it has a multi-lobe configuration, with a plurality of projections 32 angled towards the molding cavity 6 of the mould 3 and which can be connected to a matching plurality of windows 11 collectively attached to a single cavity 13, or to a plurality of individual cavities, not illustrated in the accompanying drawings.

Figure 4:
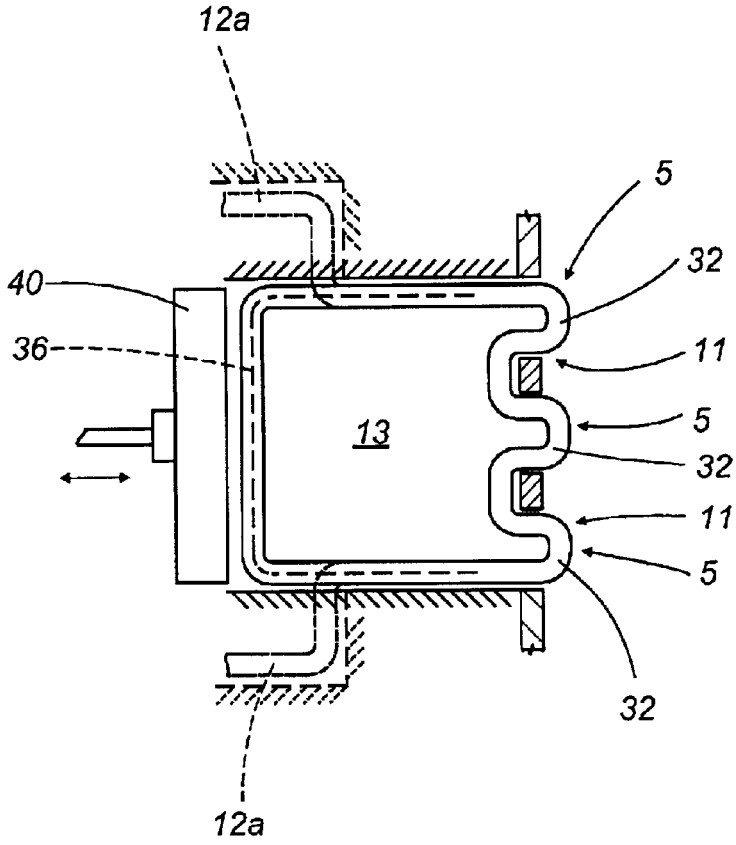

FIG. 4 also illustrates an alternative embodiment with a cover 12*a* with variable cross-section.

Outside the cover 12, the punch 5 may be fitted with a casing 16 covering at least part of the cover 12 itself.

The casing 16, of suitable thickness, may be integrated in a single body with the cover 12. The cover 12 and casing 16 together form a preferred embodiment of the punch 5 as a whole. However, the cover 12 alone may act as the punch 5, as indicated in the description below.

The casing 16 and/or cover 12 are preferably made of an elastomeric material. A silicone rubber with the following characteristics: great elasticity, great resistance to abrasion, with Poisson coefficient 0.5 and linear elastic behavior within a wide range of loads, is preferred for the application in question.

Despite this, alternative embodiments of the punch 5 are possible, which, as well as involving the use of a casing 16 of a size which covers a more or less large portion of the cover 12, may also involve the use of different construction materials, which may be recessed inserts 31 or caps 34 surrounding the end portion of the cover 12, as illustrated in FIG. 3. The choice of the material for the casing 16, the material for the inserts 31 or caps 34, that is to say, the choice of elastic, elastomeric or rigid materials, which may be suitably combined, may be dictated by various requirements. For example, the need to provide the punch 5 with suitable resistance to abrasion by the slip, and/or the need to make openings, cavities, stamping or decorations and/or surfaces with smooth, well-defined borders and without burrs on the sides of the ceramic product 2 being made.

As regards the internal cavity 13 of the cover 12, FIG. 1 illustrates an open cavity 13, intercommunicating with the outside and designed to exchange the fluid substance 17 needed for punch 5 operation with it. Vice versa, in FIG. 4 punch 5 operation is achieved using a closed cavity 13, therefore, operating without exchanging the mass of fluid substance 17 with the outside.

The fluid substances 17, which can be used in the punch 5 cavity 13, may be numerous and varied. It is possible to use a gaseous fluid which can be compressed, such as air, gas, steam, etc. or even a liquid which cannot be compressed, such as oil and water, or a gelatinous fluid, more or less viscous, or even loose solid substances, provided that they run smoothly, as do some finely separated solid powders.

The punch 5 shape variation differential constriction means consist of a seat 14 in the body 15 of the mould 3, in which the punch 5 is housed.

The seat 14 has rigid walls formed by a tubular body 39, open at one end, and a base wall 10, closing the opposite end of the tubular body 39.

The seat 14 is located on the opposite side of one of the mould 3 molding surfaces 7 to the side on which the molding cavity 6 is located. The seat is joined to the molding surface 7 at a window 11 made in the surface, whose shape matches the shape of the opening 4 or cavity which is to be made in the side of the ceramic product 2 being made.

In FIGS. 1 and 2 of the accompanying drawings, the tubular body 39 of the seat 14 has a circular cylindrical shape. However, this is by way of example only and does not limit the scope of the invention, regarding the possible configuration, since the seat 14 may have various shapes, that is to say, it may be a circular cylinder, an elliptical cylinder, or prismatic, or even prismatic with a star-shaped base.

Observation of FIG. 3 also reveals that the cover 12 shape variation differential constriction means may consist, alternatively, but also in addition to the seat 14, of a cage or a case 8 which encompasses the punch 5 cover 12, or the casing 16, along at least part of its side surface.

The cage or case 8 is designed to counteract the corresponding transversal expansion of the cover 12 however it is obtained—when suitably deformed, leaving the punch 5 free to expand along its axial direction 29 so that it can exit the window 11.

The cage or case 8 may have many shapes. One of them, illustrated in FIG. 3 by way of example and without limiting the scope of the invention, includes one or more rings 30 located on the punch 5, around the casing 16, so as to circumscribe at least part of the side surface of the punch 5.

The cage 8 may be made of an antifriction material, such as tetrafluoropolyethylene, so that it does not prevent the cover 12 shape changes along its axial direction 29; or it may consist of rings 30, with a circular cross-section, which may move independently of one another, designed to substitute sliding friction with rolling friction. The latter characteristic is particularly advantageous when the rings 30 interact, on one hand with the side surface of the punch 5, and on the other hand with the rigid wall 9 of the tubular body 39 of the seat 14, whose rubbing may in the long-term wear the side surface of the punch 5.

The cover 12 shape variation differential constriction means 8 may consist, in addition to or alternatively to the embodiment just described, of the same structure as the cover 12 or casing 16 when they are designed so that they are capable of the above-mentioned anisotropic deformation.

In this particular context, another example of this possibility is offered by the punch 5 configuration illustrated in FIG. 4, in which the projections 32 on the cover 12, with or without the casing 16, may be made in such a way that they are more deformable than the remaining part of the cover 12 inside the seat 14. In this case, the constriction means evidently represented by the greater inelasticity of the part of the cover 12 without the projections 32, allow the cover 12 to be deformed more longitudinally to its axial direction 29 and confine all or most of the deformation to the projections 32 themselves, which can be projected though the relative windows 11 into the forming cavity 6, or removed from the molding cavity 6, depending on the requirements of the moment relative to the ceramic product 2 molding cycle.

The actuator means 33 which activate the punch 5 deformation are made in different shapes, partly linked to the nature of the fluid substance 17 used, and whether or not the cover 12 internal cavity 13 is designed to exchange the mass of fluid substance 17 with the environment outside the punch 5.

In a first embodiment, illustrated in FIGS. 1 and 2, the actuator means 33 comprise: a delivery pipe 18 communicating with the cover 12 internal cavity 13; and pressurized fluid generator means 21, connected to the delivery pipe 18.

Delivery pipe 18 valve means 19—symbolically represented in a basic embodiment by way of example and without limiting the scope of the invention—operate between two opposite conditions. In one condition they stop any reflux, towards the outside, of the fluid substance 17 in the cover 12 cavity 13. In the other condition, they allow the fluid generator means 21 to pressurize the cover 12 from the inside.

Cover 12 internal pressurization changes the shape of the cover until it interacts with the rigid walls 9 and 10 of the tubular body 39, allowing the punch 5 to exit the window 11 and project into the molding cavity 6.

Cover 12 internal pressurization may be obtained either using a fluid substance which cannot be compressed, as illustrated in FIG. 1, or with a fluid substance which can be compressed.

However, if the cover 12 internal cavity 13 is not in a condition to exchange the mass of fluid substance 17 with the outside—for example because intercommunication with the outside is prevented either due to the construction or because the outlet is temporarily blocked—the actuator means 33 may be made in such a way as to deform the punch 5 by pressurizing the fluid substance 17 inside with a deforming action applied mechanically from the outside.

FIG. 4 shows how, by crushing or squeezing the cover 12, at part of its side surface and directed from the outside inwards, it is possible to achieve a controlled pressurization of the fluid mass 17 contained in the cavity 13, suitably deforming the remaining parts of the punch 5, and allowing the punch to project into the molding cavity 6 and be held there rigidly enough to bear the mechanical actions of the slip during molding of the ceramic product 2.

In this case, the use of a gelatinous or powdery fluid substance 17 inside the cover 12 cavity 13 is preferred. The crushing action may be produced in a variety of ways, for example using a mechanical or hydraulic piston 40 connected to the cover 12 at the base 10 of the seat 14.

The device 1 also comprises means for free or forced punch 5 retraction under the molding surface 7, designed to depress the cover 12 and to draw the punch 5 back into the tubular seat 14, in the absence of pressure in the cover 12 internal cavity 13, however this may be produced.

In the first case, that is to say, with free retraction, the retraction means may consist of the elasticity of the material used to make the punch 5. The spontaneous elastic contraction of the material used to make the cover 12 and/or the casing 16 integral with it, following depressurization of the cover 12 internal cavity 13, may be sufficient to draw the punch 5 back into its seat 14 when necessary.

If the retraction means are designed for forced punch 5 retraction below the molding surface 7, such a solution is easily obtained by connecting the device 1 to vacuum generator means (not illustrated in the accompanying drawings, being of the conventional type) which create a vacuum in the punch 5 cavity 13 sufficient to draw the punch 5 back into the seat 14, when necessary due to the functional requirements of the mould 3 operating cycle.

In practice, device 1 operation may be briefly described by observing that suitable pressurization of the cover 12 internal cavity 13 allows the punch 5 to be deformed in such a way as to give it suitable rigidity, making it gradually exit its seat 14 by a preset and controlled distance from the molding surface 7 (compare FIGS. 1 and 2 in particular) and correlated to the thickness of the side of the product 2.

With the punch 5 in these conditions, the material used to make the ceramic product 2, that is to say, the "slip" is fed into the molding cavity 6. After a time suitable for molding the side of the product 2 being made and allowing sufficient hardening (in accordance with know methods, which do not fall within the scope of the present invention, and therefore, are omitted), the punch 5 is drawn back into its seat 14 so that, with the molding already complete, it allows the product 2 to be removed in any direction, that is to say even across the direction of movement of the punch 5 in or from its seat 14.

It must be emphasized that the invention described above fulfils the preset aims with an embodiment which is distinguished by its simple, economical construction and great operating safety and durability.

As regards operating safety, it must be noticed that the punch 5 described above acts in conjunction with the wall of the seat 14 of the mould 3 which houses it in the mass of material, with circumferential interference, whose intensity may be dosed in any way by adjusting the more or less intense pressurization of the punch 5 internal cavity 13. It is, therefore, possible to achieve a strong seal between the punch 5 casing 16 which is elastic, or at least deformable, and the rigid wall of the seat 14 which opposes the punch 5 circumferential expansion. This seal guarantees that during slip pressure molding, the slip does not infiltrate the seat 14 housing the punch 5 between the casing 16 and the rigid countering wall 9 or 10.

In the case of molding by pressure casting, the punch 5 helps to make the above-mentioned seal even more effective.

The pressures exerted by the slip against the part of the punch 5 which is prominent in the molding cavity 6, counteracted in the opposite direction by the internal pressure in the punch 5 cavity 13, produce a further increase in the initial circumferential interference between the casing 16 and the tubular body 39. The intensity of this interference increases with an increase in the pressure of the slip against the punch 5. If the fluid substance 17 is of the type which cannot be compressed, and if the valve means 19 are configured in such a way as to stop fluid reflux from the chamber 13 to the generator means 21, all of this makes it practically impossible for the slip to penetrate the seat 14 housing the punch 5 and to compromise correct operation of the device 1.

As regards resistance to wear caused by the rubbing when the ceramic slip is poured into the mould 3, the use of a punch 5 made of a material which resists wear (and the silicone material of the casing certainly is) means that it may be safely assumed that the device 1 will have a long life. Despite this, the same result may be achieved with punches 5 which are at least partially made of metal, provided that they are structured in such a way as to create a seal with the rigid walls 9 and 10 of the seat 14.

In addition, the simplicity of the construction and assembly and reduced costs of the device 1 allow easy substitution of the punch 5 when necessary after intolerable deterioration of the outer surface of the casing 16.

In terms of device 1 reliability, the absence of moving parts indicates that it is most reliable, if considered per se, or if compared with the movement of the parts of the mechanical devices already known to experts in the sector.

The invention described may be used for evident industrial applications and can be subject to numerous modifications and variations without thereby departing from the scope of the inventive concept. Moreover, all the details of the invention may be substituted by technically equivalent elements.

What is claimed:

1. A device for producing an opening or cavity in the side of a ceramic product during product molding in a mould, the mould having a molding cavity delimited by a molding surface which has a window, the ceramic product being removable from the mould in a direction, the device comprising:

a punch joined on the window in such a way that it projects into or retracts from the molding cavity, the punch having a cover and being expandable with variations in its rigidity;

differential constriction means of punch shape variation;

actuator means for deforming the punch which, in the active condition, change the punch shape against the opposing reaction of the constriction means, the constriction means and the actuator mean producing a controlled anisotropic deformation of the punch, so that the punch projects into the molding cavity; and means for retracting the punch under the molding surface, to depress the cover and to draw the punch back into a seat, wherein the product, with the molding already complete, is removable across the direction of movement of the punch in or from its seat.

2. The device according to claim 1, wherein the cover comprises an inner cavity designed to contain a fluid substance, the cover being deformable due to the action of the fluid substance which it contains.

3. The device according to claim 2, wherein the internal cavity is closed to prevent exchanges of the fluid substance with the environment outside said cavity.

4. The device according to claim 2, wherein the cavity is open to allow exchanges of the fluid substance with the environment outside the cavity.

5. The device according to claim 2, wherein the fluid substance is gaseous.

6. The device according to claim 2, wherein the fluid substance is a liquid.

7. The device according to claim 2, wherein the fluid substance is a loose solid substance.

8. The device according to claim 7, wherein the loose solid substance is a finely separated powder.

9. The device according to claim 2, wherein the fluid substance is a gelatinous substance.

10. The device according to claim 2, wherein the cover is expandable due to a pressure difference acting between the internal fluid substance and the environment outside the cavity.

11. The device according to claim 10, wherein the cover is made of an elastic material.

12. The device according to claim 10, wherein the cover is made of a material with deformability which varies according to the direction of deformation, the differential constriction means being made of the same material as the cover.

13. The device according to claim 12, wherein the cover includes a framework designed to give the cover a preset anisotropic deformation capacity.

14. The device according to claim 2, wherein the cover has a plurality of projections which can be attached to a matching plurality of windows.

15. The device according to claim 14, wherein a single cavity is controlled by the projections in such a way as to project the punches into the molding cavity or retract them from the molding cavity.

16. The device according to claim 14, comprising a plurality of cavities controlled by the projections so as to project the punches into the molding cavity or retract them from the molding cavity.

17. The device according to claim 1, wherein the punch has a casing of suitable thickness for covering the cover, at least partially.

18. The device according to claim 17, wherein the casing is made at least partially of an elastomeric material.

19. The device according to claim 18, wherein the elastomeric material is a silicone rubber.

20. The device according to claim 17, wherein the casing is made of metal.

21. The device according to claim 17, wherein the casing incorporates at least one insert made of a suitable material.

22. The device according to claim 17, wherein the casing is covered by a cap made of a suitable material.

23. The device according to claim 17, wherein the casing and the cover are integral, forming a single body.

24. The device according to claim 1, wherein the punch is fitted with a suitably thick casing.

25. The device according to claim 24, wherein the casing is made of an elastomeric material.

26. The device according to claim 25, wherein the elastomeric material is a silicone rubber.

27. The device according to claim 24, wherein the casing is at least partially made of metal.

28. The device according to claim 24, wherein the casing incorporates at least one insert made of a suitable material.

29. The device according to claim 28, wherein the insert is made of a material which is resistant to abrasions.

30. The device according to claim 24, wherein the casing is covered by a cap made of a suitable material.

31. The device according to claim 24, wherein at least the casing of the punch is made from a material with deformability which varies according to the direction of deformation, the differential constriction means being made of the same material as the casing.

32. The device according to claim 31, wherein the casing of the punch includes a framework designed to give the casing an anisotropic deformation capacity.

33. The device according to claim 24, wherein the casing has a plurality of projections which can be attached to a plurality of windows.

34. The device according to claim 1, wherein the punch shape variation differential constriction means consist of a seat in the body of the mould, delimited by rigid bordering walls, attached to the window and housing the punch, the rigid walls counteracting the punch deformation and making part of the punch exit the window and move into the molding cavity of the mould, at a position corresponding to the opening or cavity in the ceramic product being made.

35. The device according to claim 34, wherein the seat has a tubular configuration and has a closing base wall, located in a position opposite that of the window.

36. The device according to claim 35, wherein the seat is cylindrical in shape.

37. The device according to claim 36, wherein the cylindrical shape of the seat has an elliptical cross-section.

38. The device according to claim 35, wherein the seat is prismatic in shape.

39. The device according to claim 35, wherein the seat is prismatic with a star-shaped base.

40. The device according to claim 1, wherein the punch shape variation differential constriction means comprise a cage or case which encompasses the punch along at least part of its side surface, counteracting its deformation, leaving the punch free to expand along a punch axial direction.

41. The device according to claim 40, wherein the cage or case includes at least one ring designed to circumscribe the cover.

42. The device according to claim 41, wherein each of the rings has a circular cross-section.

43. The device according to claim 40, wherein the cage or case is made of an antifriction material.

44. The device according to claim 43, wherein the antifriction material is a tetrafluoropolyethylene material.

45. The device according to claim 34, wherein a cage or case is housed in the seat.

46. The device according to claim 34, wherein the seat has a variable cross-section, there being a cover with correspondingly variable cross-section housed in the seat.

47. The device according to claim 1, wherein the actuator means are designed to exert a localized contact pressure on part of the outer surface of the punch, the pressure being intended to produce a corresponding deformation of another part of the punch and the consequent punch projection into or retraction from the molding cavity.

48. The device according to claim 47, wherein the actuator means operate with a fluid substance which cannot be compressed.

49. The device according to claim 47, wherein the actuator means operate with a fluid substance which can be compressed.

50. The device according to claim 2, wherein the actuator means comprise a delivery pipe which communicates with the cover internal cavity; and pressurized fluid substance generator means connected to the delivery pipe.

51. The device according to claim 50, wherein the actuator means comprise valve means for the delivery pipe, operating between two opposite conditions, in one of which they prevent any reflux to the outside of the fluid contained in the cover cavity.

52. The device according to claim 2, comprising means for free retraction of the punch behind the molding surface, being designed to depress the cover and draw the punch out of the molding cavity, if the cover internal cavity is not pressurized.

53. The device according to claim 52, wherein the cover is made of an elastic material, the free retraction means consisting of the spontaneous elastic contraction of the material used to make the cover following depressurization of its internal cavity.

54. The device according to claim 2, comprising means for the forced retraction of the punch below the molding surface, being designed to apply to the punch, from the outside, a vacuum suitable for drawing the punch back into the seat.

55. The device according to claim 54, wherein the forced retraction means comprise means for generating a vacuum inside the cover cavity.

* * * * *